US006641436B2

(12) United States Patent
Baffert

(10) Patent No.: US 6,641,436 B2
(45) Date of Patent: Nov. 4, 2003

(54) ANGLED COAXIAL ELECTRICAL CONNECTOR DEVICE

(75) Inventor: Jean-Marc Baffert, Charavines (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 10/132,888

(22) Filed: Apr. 25, 2002

(65) Prior Publication Data

US 2002/0177358 A1 Nov. 28, 2002

(30) Foreign Application Priority Data

May 22, 2001 (FR) ..... 01 06720

(51) Int. Cl.[7] ..... H01R 9/05
(52) U.S. Cl. ..... 439/582
(58) Field of Search ..... 439/582, 578–581, 439/583–585, 252, 246, 20

(56) References Cited

U.S. PATENT DOCUMENTS 5,277,590 A * 1/1994 Thomas et al. ..... 439/20
5,882,226 A * 3/1999 Bell et al. ..... 439/582
6,099,350 A * 8/2000 Wright ..... 439/582

* cited by examiner

*Primary Examiner*—Gary Paumen
*Assistant Examiner*—James R. Harvey
(74) *Attorney, Agent, or Firm*—Schweitzer Cornman Gross & Bondell LLP

(57) ABSTRACT

The present invention provides an angled coaxial electrical connector device, comprising a box suitable for being fixed on a base and a coaxial connector element suitable for being assembled with said box and comprising first and second generally tubular portions having respective perpendicular axes, the first portion having a coaxial contact element and the second portion being suitable for receiving a coaxial cable, the box presenting an internal cavity suitable for receiving at least part of said first tubular portion, and wherein one of the elements taken from the connector element and the box includes a housing formed by an annular groove, and the other element includes at least one portion in relief, each such portion in relief presenting an elastically deformable tab suitable for snap-fastening in said annular groove, said tab being suitable for sliding in said annular groove when the connector element and the box are assembled together so that the connector element is free to turn relative to the box about an axis of rotation associated with the box.

10 Claims, 3 Drawing Sheets

ANGLED COAXIAL ELECTRICAL CONNECTOR DEVICE

The present invention relates to an angled coaxial electrical connector device, serving in particular to enable a coaxial cable to be connected to a base.

BACKGROUND OF THE INVENTION

U.S. Pat. No. 5, 277, 590 discloses an electrical connector enabling a coaxial cable to be connected to a connector element which is fixed to a panel, for example. The connector comprises an outer body receiving two subassemblies that are free to turn about two respective axes of rotation that are perpendicular. Those subassemblies are put into place in the outer body so as to be free to turn by means of rings. That known connector has a large number of parts and requires a relatively large number of operations to be performed when assembling the parts.

OBJECTS AND SUMMARY OF THE INVENTION

There thus exists a need for an angled coaxial connector device that is free to turn about an axis and that is easy to make.

The invention achieves this by a novel angled coaxial electrical connector device comprising a support element suitable for fixing on a base and a coaxial connector element suitable for being assembled with said support element, the connector element comprising first and second generally tubular portions interconnected in particular via a right angle, the first portion including a coaxial contact element and the second portion being suitable for receiving a coaxial cable, wherein one of the elements taken from the connector element and the support element has at least one housing and the other element has at least one portion in relief suitable for engaging in said housing and capable of moving therein, the housing and the portion in relief also being arranged in such a manner that when the connector element and the support element are assembled together, the connector element is free to turn at least through part of a revolution relative to the support element about an axis of rotation associated with the support element.

By means of the invention, the connector element is free to turn relative to the support element through at least a fraction of a revolution by means of a housing and a portion in relief that can be made directly on said elements and that do not require additional elements such as rings to be fitted.

The device of the invention is thus simple and economic to make.

It is advantageous to make a housing that extends over an angle of 360° since the connector element can then occupy all possible angular orientations about the above-mentioned axis of rotation.

It is thus possible to manufacture a single type of connection device suitable for occupying different angular orientations, and suitable for replacing different types of connector, thereby reducing costs, in particular by improved stock management.

When the connector element and the support element are assembled together, the axis of rotation preferably coincides with the axis of the first tubular portion.

In an embodiment of the invention, the portion in relief is suitable for snap-fastening in the housing, thus making the support element and the connector element particularly simple and quick to assemble together.

The portion in relief can be made on the support element and the housing can be made in the connector element.

Advantageously, the portion in relief comprises an elastically deformable tab and the housing comprises an annular groove, said tab being suitable for sliding in said annular groove.

The annular groove can be made in the outside surface of the first tubular portion over a fraction thereof situated in front of the connection zone between the first and second tubular portions.

In a particular embodiment of the invention, the connector element comprises a body on which the first and second circularly tubular portions are made.

In an embodiment of the invention, prior to being put into place in the support element, the connector element is preassembled, i.e. it already has all of its component elements.

The support element preferably comprises a box presenting an inside cavity suitable for receiving at least part of the first tubular portion of the connector element.

This cavity preferably presents a cross-section that is generally circular and that matches the outside section of the first tubular portion.

The box can be made of a plastics material.

The above-mentioned elastically-deformable tab is advantageously made integrally with the above-mentioned box.

The box can have an outside shape selected so as to provide a keying function for the connector device, the outside shape of the box possibly being substantially that of a rectangular block, for example.

The support element can be arranged so as to be fixed to a base by snap-fastening, in particular it can have an orifice suitable for receiving a portion in relief on the base.

The support element may include a locking element that is movable between first and second positions, the first position allowing the connector element to be mounted in the support element and the second position preventing the connector element from being withdrawn from the support element while allowing the connector element to turn freely.

The locking element advantageously comprises an orifice for passing said first tubular portion and a solid region adjacent to said orifice and suitable for engaging in a groove of the connector element when the locking element is in the second locking position.

The invention also provides an angled coaxial electrical connector device comprising a box suitable for being fixed on a base, and a coaxial connector element suitable for being assembled with said box and having first and second generally tubular portions having respective perpendicular axes, the first portion including a coaxial contact element and the second portion being suitable for receiving a coaxial cable, the box having an inside cavity suitable for receiving at least part of said first tubular portion, and one of the elements selected from the connector element and the box including a housing formed by an annular groove and the other element including at least one portion in relief, each such portion in relief comprising an elastically deformable tab suitable for snap-fastening in said annular groove, said tab being suitable for sliding in said annular groove when the connector element and the box are assembled together, whereby the connector element is free to turn relative to the box about an axis of rotation associated with the box.

BRIEF DESCRIPTION OF THE DRAWINGS

The invention will be better understood on reading the following detailed description of a non-limiting embodiment, and on examining the accompanying drawings, in which.

MORE DETAILED DESCRIPTION

Figure 1:
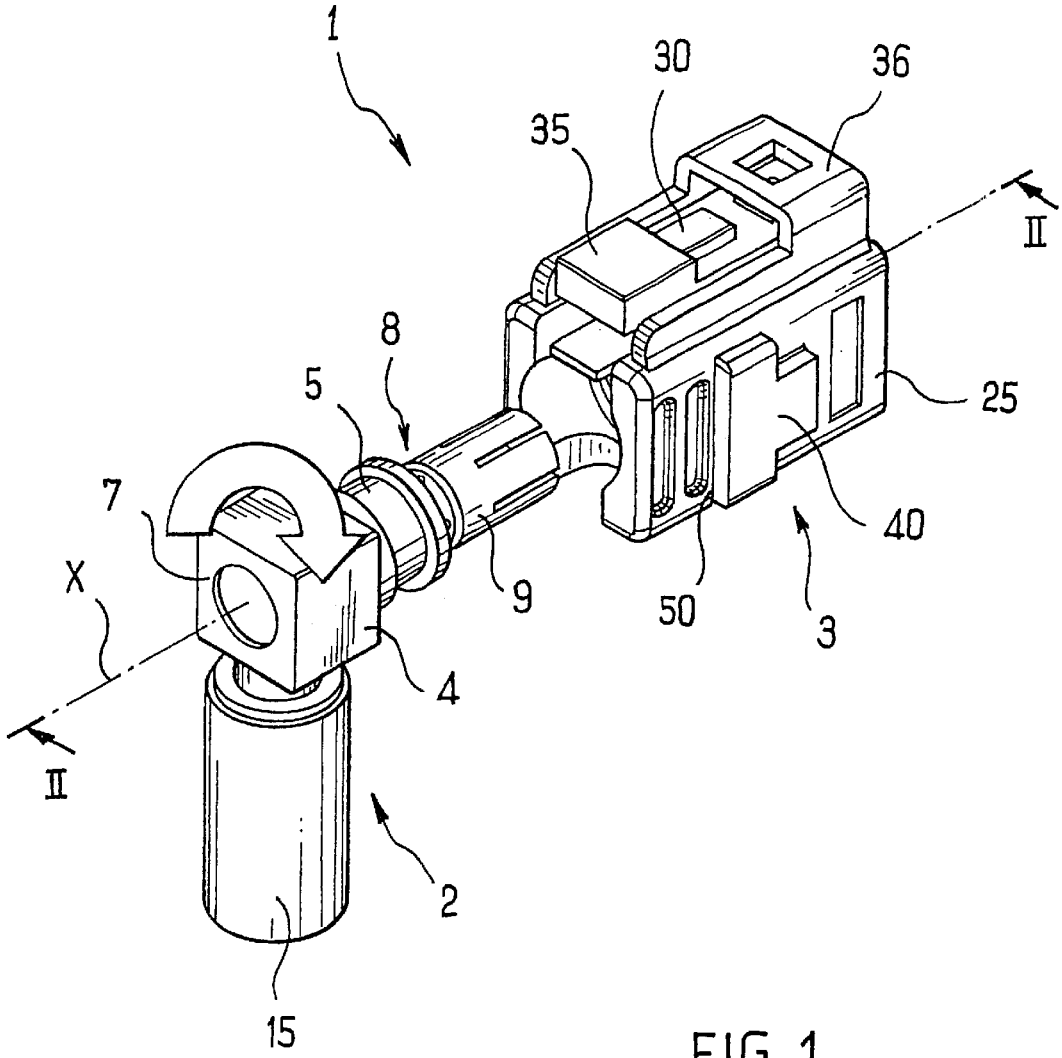
FIG. 1 is a diagrammatic, fragmentary perspective view of a coaxial connector device of the invention prior to assembling the support element and the connector element together.
Figure 2:
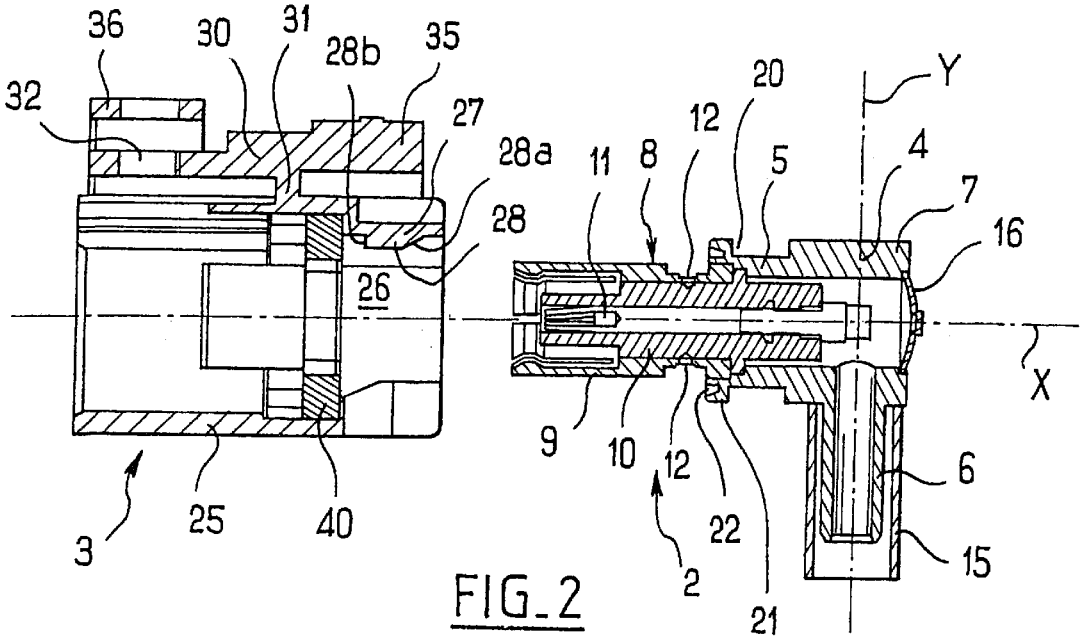
FIG. 2 is a diagrammatic section view on II—II through the FIG. 1 device.

FIG. 1 shows a coaxial electrical connector device 1 in accordance with the invention, comprising a coaxial connector element 2 and a support element 3.

The device 1 serves to connect a coaxial cable (not shown) to a socket base (not shown) fixed to a panel.

The connector element 2 comprises a body 4 having a right-angle bend, defining first and second tubular portions 5 and 6 which are circularly cylindrical about respective perpendicular axes X and Y. These portions 5 and 6 are connected together by means of a bend 7 whose outside shape is generally that of a rectangular block. The bend 7 has a rear opening closed by a stopper 16.

The first tubular portion 5 receives a coaxial contact element 8 constituted by an outer conductor 9, insulation 10, and a central conductor 11, the insulation 10 being held in the outer conductor 9 by local deformation of the wall of said outer conductor 9 in the bottom of a groove 12 therein.

The second tubular portion 6 is designed to receive a coaxial cable whose central contact is soldered to the central contact 11. The coaxial cable is put into place in the tubular portion 6 by crimping by means of a sleeve 15.

The outside surface of the tubular portion 5 includes an annular groove 20 whose function is described below. This groove 20 is of rectangular cross-section and it is defined forwardly by a rim 21. The rim has an annular groove 22 facing towards the front of the tubular portion 5 and defines a thin wall 29 suitable for being folded down onto the outer conductor 9 so as to lock it in the body 4.

The support element 3 comprises a box 25 defining an inside housing 26 designed to receive the tubular portion 5 and the contact element 8. The box 25 is made as a single piece, e.g. by molding a plastics material, and its outside shape is generally in the form of a rectangular block.

Figure 3:
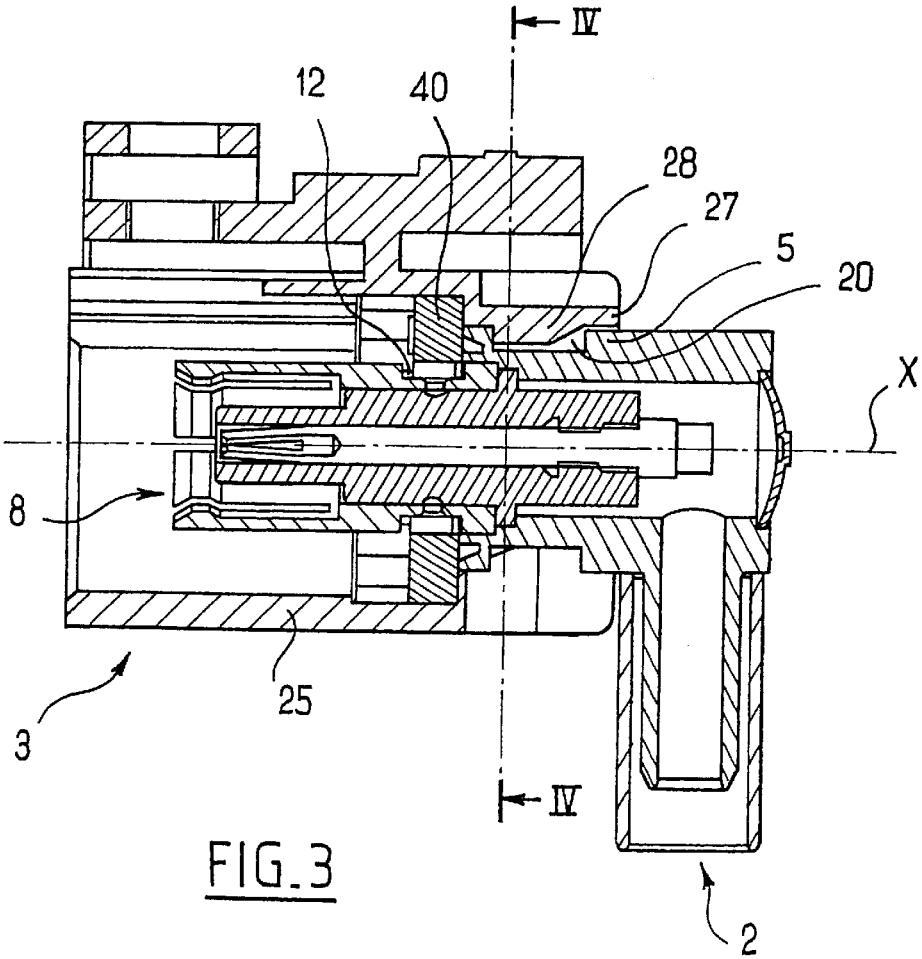
FIG. 3 is a view analogous to FIG. 2, showing the connector element and the support element assembled together.

The box 25 has an elastically deformable tab 27 presenting a projection 28 directed towards the housing 26. This projection 28 is designed to engage in the above-mentioned annular groove 20, as can be seen in FIG. 3, in particular. Towards the front the projection 28 has a sloping flank **28*a* enabling the tab 27 to go past the rim 21, and towards the rear it has a straight flank 28*b* opposing withdrawal of the tab 27 from the groove 20** once the connector element and the support element have been assembled together.

Figure 4:
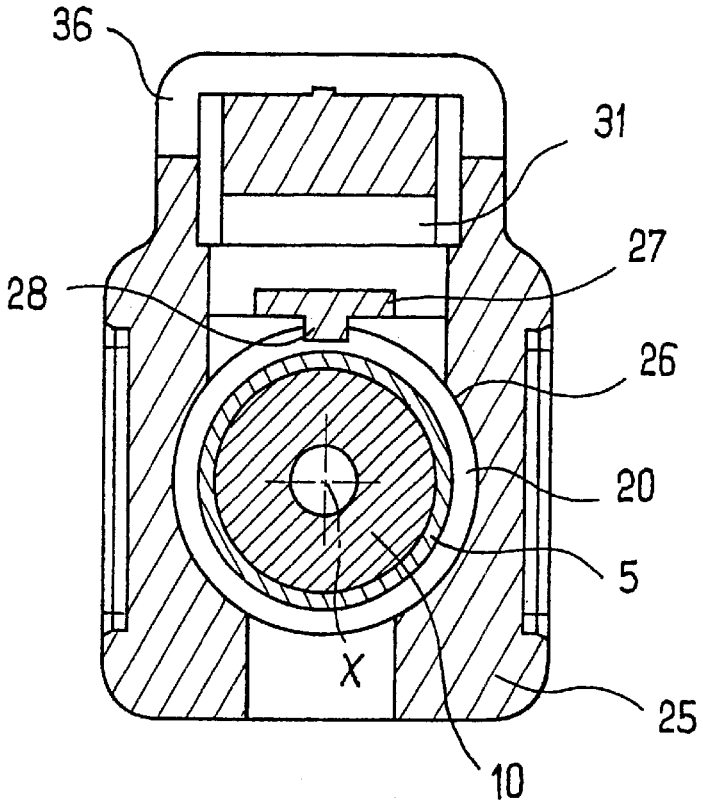
FIG. 4 is a diagrammatic fragmentary section view on IV—IV through the FIG. 3 device.

As can be seen in FIG. 4 in particular, the housing 26 presents a cross-section that is generally circular and that matches the tubular portion 5. Thus, when the connector element 2 is assembled with the support element 3, the connector element 2 is free to turn about the axis of rotation X, with the projection 28 of the tab 27 being free to move in the groove 20.

In the example described, the box 25 has a top wall 30 connected to the remainder of the box 25 by a web of material 31, the back of said top wall being pierced by an orifice 32.

This square-section orifice 32 is designed to receive by snap-fastening a portion in relief of the base onto which the support element 3 is to be fixed.

The wall 30 can tilt about the web of material 31 so as firstly to enable its rear portion pierced by the orifice 32 to rise during insertion of the portion in relief of the base into said orifice 32, and secondly to enable an operator to press on the front portion 35 thereof so as to raise said rear portion and enable the portion in relief on the base to be withdrawn from the orifice 32.

The rear portion of the wall 30 is surmounted by a protective wall 36.

Figure 5:
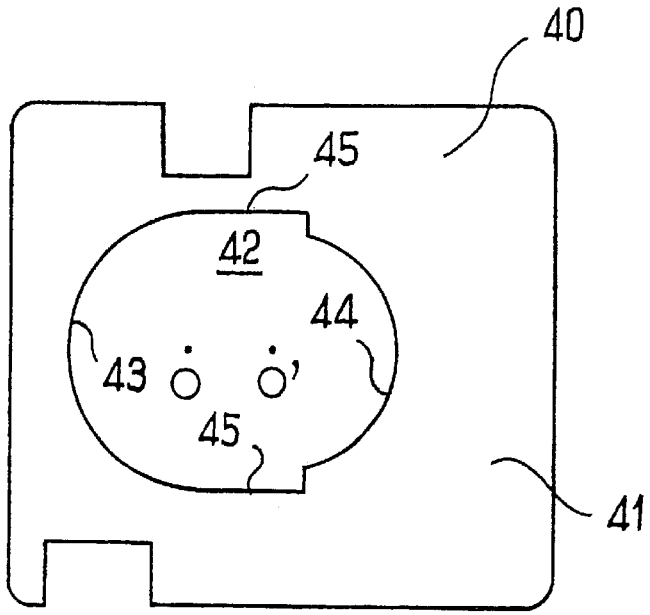
FIG. 5 is a diagrammatic and fragmentary view showing the locking element of the support element in isolation.

The support element 3 also has a locking element 40 shown in isolation in FIG. 5 and serving to prevent the connector element 2 from being withdrawn from the box 25 once they are assembled together. This locking element 40 presents a front face 41 pierced by an orifice 42 having an edge 43 (to the left in FIG. 5) that is semicircular on center O, and another edge 44 (to the right in FIG. 5) that is substantially semicircular on center O'.

The circle defining the edge 43 has a radius that is greater than that of the circle defining the edge 44, the radius of the first circle being adapted for insertion of the first tubular portion 5. These edges 43 and 44 are connected together via straight edges 45.

The locking element 40 is put into place transversely inside the housing 26, being inserted into the box 25 via two openings 50 made in the side walls of the box 25.

The locking element 40 can move between an assembly position and a locking position.

In the assembly position, the center O lies on the axis X so that an operator can insert the contact element 8 through the orifice 42 while putting the connector element 2 into place in the box 25.

Once it has been put into place, the locking element 40 is moved into its locking position so that the center O' lies on the axis X, with the solid region of the locking element 40 adjacent to the edge 44 then being engaged in the groove 12 in such a manner as to prevent the connector element 2 being withdrawn from the box 25 in an axial direction, while still leaving the connector element 2 free to turn.

After the connector element 2 has been put into place in the box 25 and has been locked by means of the locking element 40, the connector element 2 can turn freely relative to the box 25 about the axis X.

What is claimed is:

1. An angled coaxial electrical connector device, comprising a box suitable for being fixed on a base and a coaxial connector element suitable for being assembled with said box and comprising first and second generally tubular portions having respective perpendicular axes, the first portion having a coaxial contact element and the second portion being suitable for receiving a coaxial cable, the box presenting an internal cavity suitable for receiving at least part of said first tubular portion, and wherein one of the elements taken from the connector element and the box includes a housing formed by an annular groove, and the other element includes at least one portion in relief, each such portion in relief presenting an elastically deformable tab suitable for snap-fastening in said annular groove, said tab being suitable for sliding in said annular groove when the connector element and the box are assembled together so that the connector element is free to turn relative to the box about an axis of rotation associated with the box.

2. A device according to claim 1, wherein said axis of rotation coincides with the axis of said first tubular portion when the connector element and the box are assembled together.

3. A device according to claim 1, wherein said portion in relief is made on the box and said housing in the connector element.

4. A device according to claim 3, wherein said elastically deformable tab is made integrally with the box.

5. A device according to claim 3, wherein said annular groove is made on the outside surface of the first tubular portion, on a fraction thereof that is situated in front of the connection zones, of the first and second tubular portions.

6. A device according to claim 1, wherein the connector element comprises a body with the first and second circularly tubular portions being made thereon.

7. A device according to claim 1, wherein said cavity presents a cross-section that is generally circular and matches the outside section of said first tubular portion.

8. A device according to claim 1, wherein the box is arranged in such a manner as to be snap-fastened on a base, the box including in particular an orifice that is suitable for receiving a portion in relief on the base.

9. A device according to claim 1, wherein the box has a locking element movable between first and second positions, the first position allowing the connector element to be mounted in the box and the second position preventing the connector element from being withdrawn from the box while leaving the connector element free to turn.

10. A device according to claim 9, wherein the locking element presents an orifice for passing said first tubular portion, said locking element also presenting a solid region adjacent to said orifice suitable for engaging in a groove of the connector element when the locking element is in its locking, second portion.

* * * * *